United States Patent [19]

Eberly, Jr.

[11] 4,013,637

[45] Mar. 22, 1977

[54] WATER INJECTION IN A HYDRODESULFURIZATION PROCESS

[75] Inventor: Paul E. Eberly, Jr., Baton Rouge, La.

[73] Assignee: Exxon Research and Engineering Company, Linden, N.J.

[22] Filed: June 3, 1975

[21] Appl. No.: 583,467

[52] U.S. Cl. ..... 208/216

[51] Int. Cl.[2] ..... C10G 23/02

[58] Field of Search ..... 208/216

[56] References Cited

UNITED STATES PATENTS

| | | | |
|---|---|---|---|
| 3,016,350 | 1/1962 | Butler et al. | 208/216 |
| 3,116,234 | 12/1963 | Douwes et al. | 208/216 |
| 3,720,602 | 3/1973 | Riley et al. | 208/216 |

*Primary Examiner*—George Crasanakis
*Attorney, Agent, or Firm*—Marthe L. Gibbons

[57] ABSTRACT

In the hydrodesulfurization of a substantially non-metal containing hydrocarbon oil, the desulfurization is improved by providing from about 1 to about 32 volume percent steam in the gas phase of the reaction zone at a start-of-run temperature ranging from about 550° to about 750° F. The addition of water is discontinued at temperatures above 750° F.

14 Claims, 4 Drawing Figures

FIGURE I

HYDRODESULFURIZATION OF SAFANIYA VACUUM GAS OIL ON $CoO-MoO_3-Al_2O_3$, 3000 SCF $H_2/B$ AND 2.78 V/V/hr

HYDRODESULFURIZATION OF SAFANIYA VGO
AT 650°F., 640 PSIG AND 2.78 V/V/HR.

WATER INJECTION IN A HYDRODESULFURIZATION PROCESS

BACKGROUND OF THE INVENTION

1. Field of the Invention

The present invention relates to a process for the desulfurization of sulfur-containing hydrocarbon oils. More particularly, it relates to a hydrodesulfurization process wherein a substantially non-metal containing sulfur-bearing hydrocarbon oil is treated with hydrogen and steam in the presence of the hydrodesulfurization catalyst.

2. Description of the Prior Art

Hydrodesulfurization processes in which water as a liquid or as a vapor is added to the hydrodesulfurization reaction zone are known. In the prior art processes, to realize an improvement in the hydrodesulfurization process by the water addition, the hydrocarbon feed treated contained considerable amounts of metallic contaminants such as vanadium and nickel (see for example U.S. Pat. No. 3,753,894) or a substantially metals free hydrocarbon feed could be utilized if the hydrodesulfurization catalyst contained nickel or vanadium (see for example U.S. Pat. No. 3,720,602 and U.S. Pat. No. 3,501,396).

It has now been found that the addition of water will enhance the hydrodesulfurization of a substantially non-metal containing sulfur-bearing hydrocarbon oil utilizing a catalyst which has not been impregnated or composited with a nickel or vanadium component. The term "substantially non-metal containing" as employed in reference to the hydrocarbon feed stream is intended in the specification and claims to define a feed stream containing less than about 80 weight parts per million of metals.

SUMMARY OF THE INVENTION

In accordance with the invention, there is provided a hydrodesulfurization process, which comprises contacting, in a reaction zone, at hydrodesulfurization conditions, a substantially non-metal containing sulfur-bearing hydrocarbon feed selected from the group consisting of vacuum gas oils, virgin gas oils, thermal and catalytic cycle oils, with a hydrogen-containing treating gas and a catalyst consisting essentially of a cobalt component and a molybdenum component composited with an alumina carrier, and injecting into said reaction zone from about 1 to about 32 volume percent $H_2O$ (based on said hydrogen containing treating gas) at reaction zone temperatures ranging from about 550° F. to less than about 750° F.

As the run proceeds and temperatures above 750° F. are obtained in the reaction zone, the addition of water is discontinued.

DESCRIPTION OF THE PREFERRED EMBODIMENT

Figure 1:
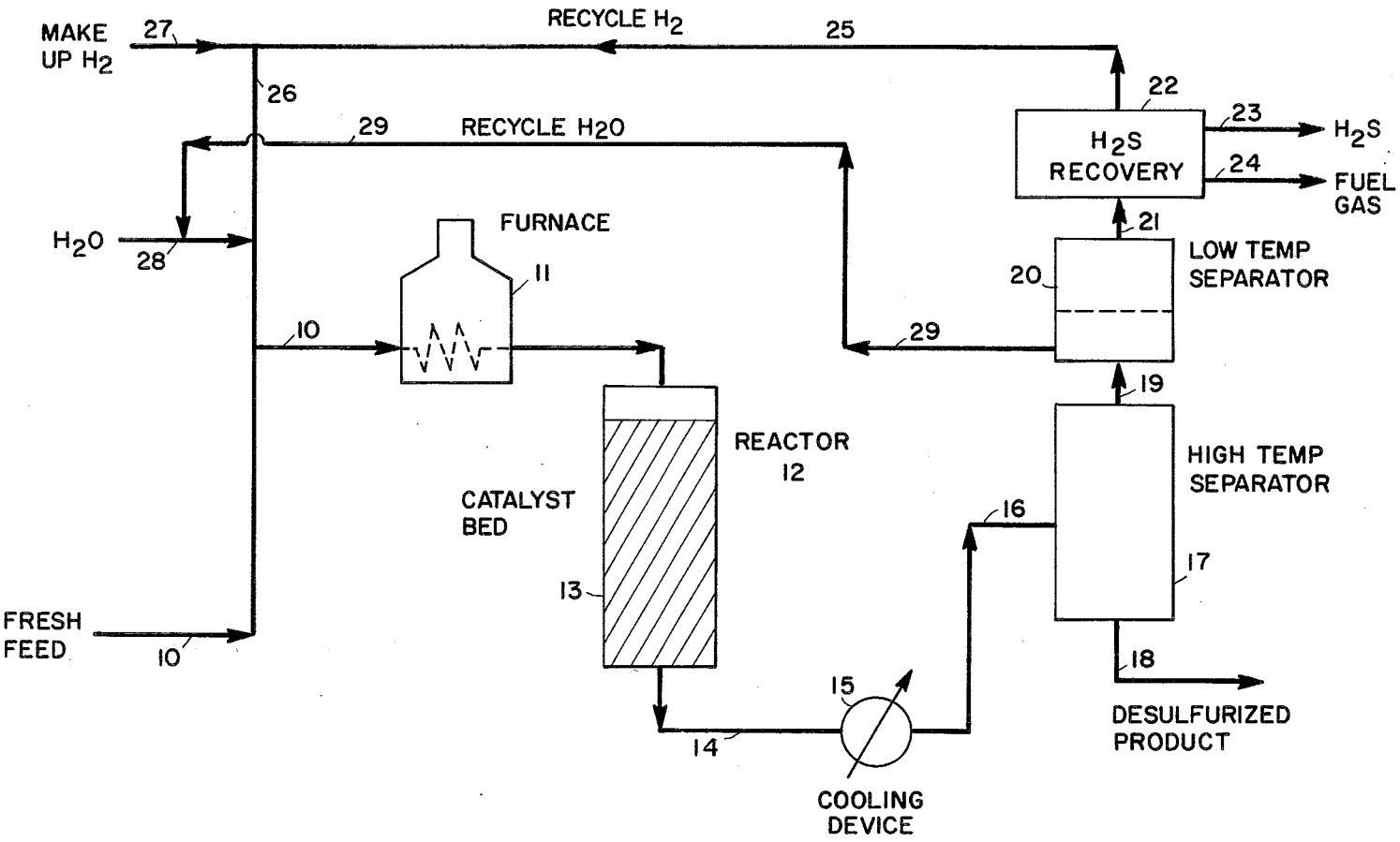
FIG. 1 is a schematic flow plan of one embodiment of the invention.

The preferred embodiment will be described with reference to FIG. 1 of the accompanying drawings. Referring to FIG. 1, a substantially non-metals containing sulfur-bearing hydrocarbon oil feed is passed by line 10 through furnace 11 into reaction vessel 12. Suitable hydrocarbon feeds include naphtha, vacuum gas oil, virgin gas oil, thermal and catalytic cycle oils. The hydrocarbon feed contains less than 80 weight part per million of total metals content (calculated as the metal) preferably less than 25 ppm total metals, more preferably less than 5 ppm total metals, most preferably less than 1 ppm total metals and may contain up to 8 weight percent sulfur, preferably at least 0.25 weight percent sulfur, typically about 0.01 to about 5 weight percent sulfur.

In reaction vessel 12, is maintained a hydrodesulfurization catalyst in fixed bed 13. Instead of maintaining the catalyst in a fixed bed, the catalyst can be maintained in a moving, fluid or ebullient bed.

The catalyst maintained in bed 13 consists essentially of a cobalt component and a molybdenum component composited with an alumina carrier which may further contain silica. The catalyst is not impregnated with a Group VB metallic component such as vanadium, niobium or tantalum prior to use nor is the catalyst composited with a nickel component prior to use. Furthermore, since the hydrocarbon feeds for the process of the present invention, such as naphthas, virgin gas oils, diesel oils, vacuum gas oils, thermal and catalytic cycle oils, are substantially metals-free, any feed metals that may deposit on the catalyst during process operation would therefore be an insignificant amount. For example, after operation for six months at 0.5 weight of hydrocarbon feed per hour per weight of catalyst (0.5 W/Hr/W) using a hydrocarbon feed containing 1 ppm vanadium, the catalyst would contain only 0.2 percent vanadium by weight, assuming complete removal of the metal from the feed.

The cobalt and molybdenum components may be present in the catalyst as free metals, metal oxides or metal sulfides. A preferred catalyst consists essentially of from about 0.2 to 10 weight percent cobalt (calculated as the metal oxide) and from about 1 to about 20 weight percent molybdenum (calculated as the metal oxide) supported on an alumina carrier or on an alumina carrier containing from about 1 to about 6 weight percent silica. Such catalytic supports containing from 1 to 6 weight percent silica can be prepared as indicated in U.S. Pat. No. 3,509,044, the teachings of which are hereby incorporated by reference. A hydrogen-rich treat gas stream 26 is combined with hydrocarbon feed stream 10 and passed through the preheat furnace 11 in which the mixture is heated to a temperature ranging from about 550° to about 750° F. prior to entering reaction vessel 12. Typically, the hydrogen-rich stream contains 60 volume percent hydrogen, the remainder being made up by light hydrocarbon gases such as $CH_4$ or $H_2S$ or possibly some $NH_3$. Water is introduced into the hydrogen-rich stream via line 28. Water may also be introduced into the hydrocarbon feed line 10 as a liquid which is converted to steam in the furnace and in the reaction vessel or the water may be introduced as steam into the hydrocarbon feed. Alternatively, the desired $H_2O$ may be introduced directly as liquid or steam into the reaction vessel 12.

Whatever the manner of introduction, the $H_2O$ is introduced in amounts sufficient to provide from about 1 to about 32 volume percent of the hydrogen-containing treat gases present in the hydrodesulfurization reaction vessel 12, preferably from about 5 to about 20 volume percent of the gaseous phase present in reaction vessel 12. The $H_2O$ is introduced into the reaction vessel either with the hydrocarbon feed or separately at start-of-run temperatures ranging from about 550° to below 750° F., preferably at start-of-run temperatures (initial operating temperature) from about 550° to about 700° F. Since the hydrodesulfurization reaction is exothermic, the temperature in the reaction zone will tend to rise above the start-of-run temperature as the run proceeds. The addition of $H_2O$ (water or steam) is discontinued when the reaction zone temperature reaches about 750° F., preferably it is discontinued when the temperature of the reaction zone reaches a temperature of about 700° F. because it has unexpectedly been found that the addition of water above a temperature of 750° F. does not enhance the desulfurization process.

The hydrodesulfurization process is operated at hydrogen partial pressures ranging from about 50 to about 4000 pounds per square inch gauge (psig), preferably from about 200 to about 2500 psig. When the $H_2O$ is being introduced into the reaction zone, the partial pressure of the steam may range from about −13.7 to about 127 psig, preferably from about −12.7 to about 800 psig, more preferably from about −3.7 to about 500 psig. The actual hydrogen partial pressure utilized is such as to be greater than the actual steam partial pressure. Suitable hydrocarbon feed liquid hourly space velocities (defined as volume of feed per hour per volume of catalyst) include a space velocity ranging from about 0.3 to about 10 volumes of hydrocarbon feed per hour per volume of catalyst, preferably from about 0.5 to about 2 volumes of hydrocarbon feed per hour per volume of catalyst. Suitable hydrogen flow rates in the reaction zone include from about 100 to about 10,000 standard cubic feet of hydrogen per barrel of hydrocarbon feed, preferably from about 200 to about 5,000 scf/b; a reaction zone temperature ranging from about 400° to about 900° F., preferably from about 650° to about 850° F. This temperature range refers to the average temperature of the reaction zone during the entire run rather than to the start-of-run temperature. Suitable reaction zone total pressure includes a pressure ranging from about 50 to about 4000 psig, preferably from about 100 to 4000 psig.

Returning to reaction vessel 12, under the given operating conditions, the sulfur-bearing substantially nonmetal containing hydrocarbon oil feed contacts the hydrogen-containing gas and the hydrodesulfurization catalyst in the presence of steam at the given start-of-run temperature. The effluent of reaction vessel 12 flows through line 14 to a cooling device 15 and then to a high temperature separator 17 via line 16. After stripping the cooled effluent in separator 17, a desulfurized product, that is, a hydrocarbon product having a lower sulfur content than the feed, is removed via line 18. In high temperature separator 17, hydrogen, hydrogen sulfide, $H_2O$ and light ends are removed via line 19 and introduced into cold separator and water disengaging drum 20 wherein the steam is condensed and recycled via line 29 to water inlet line 28. The vaporous effluent of separator 20 is introduced via line 21 to a hydrogen sulfide recovery unit 22 wherein the $H_2S$ is removed by conventional methods, such as for example by contact with a scrubbing agent such as monoethanolamine. The effluent from the scrubber, predominantly hydrogen, is recycled via line 25 with make-up hydrogen from line 27 to the furnace prior to which it may be admixed with fresh feed and $H_2O$. The alternative methods of introduction of $H_2O$ have already been described previously. The following examples are presented to illustrate the invention.

EXAMPLE 1

A catalyst having the following composition: 3.7 weight percent CoO; 13.0 weight percent $MoO_3$; 1.5 weight percent $SiO_2$ and the balance $Al_2O_3$ was calcined in air for 16 hours at 1000° F. The calcined catalyst was sulfided with 10 percent $H_2S$ in a hydrogen stream for 16 hours. A Safaniya vacuum gas oil was passed over the catalyst. The vacuum gas oil had the composition shown in Table 1.

TABLE I

| Constituent | Weight Percent |
|---|---|
| Sulfur | 2.89 |
| Carbon | 85.8 |
| Hydrogen | 11.9 |
| Conradson Carbon | 0.69 |
| **Constituent** | **Weight ppm** |
| Nitrogen | 670 |
| Na | 2 |
| Ni | 1.1 |
| V | 0.7 |
| Fe | 11.0 |

The above-indicated vacuum gas oil was passed over the catalyst at a space velocity of 2.78 volumes of gas oil per hour per volume of catalyst, and 3000 standard cubic feed of hydrogen per barrel of oil were utilized. The total pressure in the reactor was maintained at 640 psig. Runs were made without the addition of steam to the reaction zone and with the addition of steam to the reaction zone.

Results of the tests are summarized in Table II.

TABLE II

Hydrodesulfurization of Safaniya Vacuum Gas Oil (2.89% S) on GoO—$MoO_3$—$AL_2O_3$, 3000 SCF $H_2$/B and 2.78 V/V/Hr.

| Temp., ° F. | Wt. % Sp Dry | Wt. % Sp 20% $H_2O$ | $K_s$ ($H_2O$), Hr.$^{-1}$ | $K_s$ ($H_2O$) / $K_s$ (Dry) |
|---|---|---|---|---|
| 650 | 0.97 | 0.69 | 2.9 | 1.78 |
| 700 | 0.41 | 0.32 | 6.7 | 1.54 |
| 750 | 0.14 | 0.14 | 12.1 | 1.25 |

$$\text{where } K_s = \left(\frac{1}{S_p 0.5} - \frac{1}{S_f 0.5}\right) \frac{V/V/Hr.}{0.5} \frac{529}{P_{H_2}} \left(\frac{3000}{SCF/B}\right) 0.223$$

$S_p$ and $S_f$ refer to weight percent sulfur in the product and in the feed, respectively.

Figure 2:
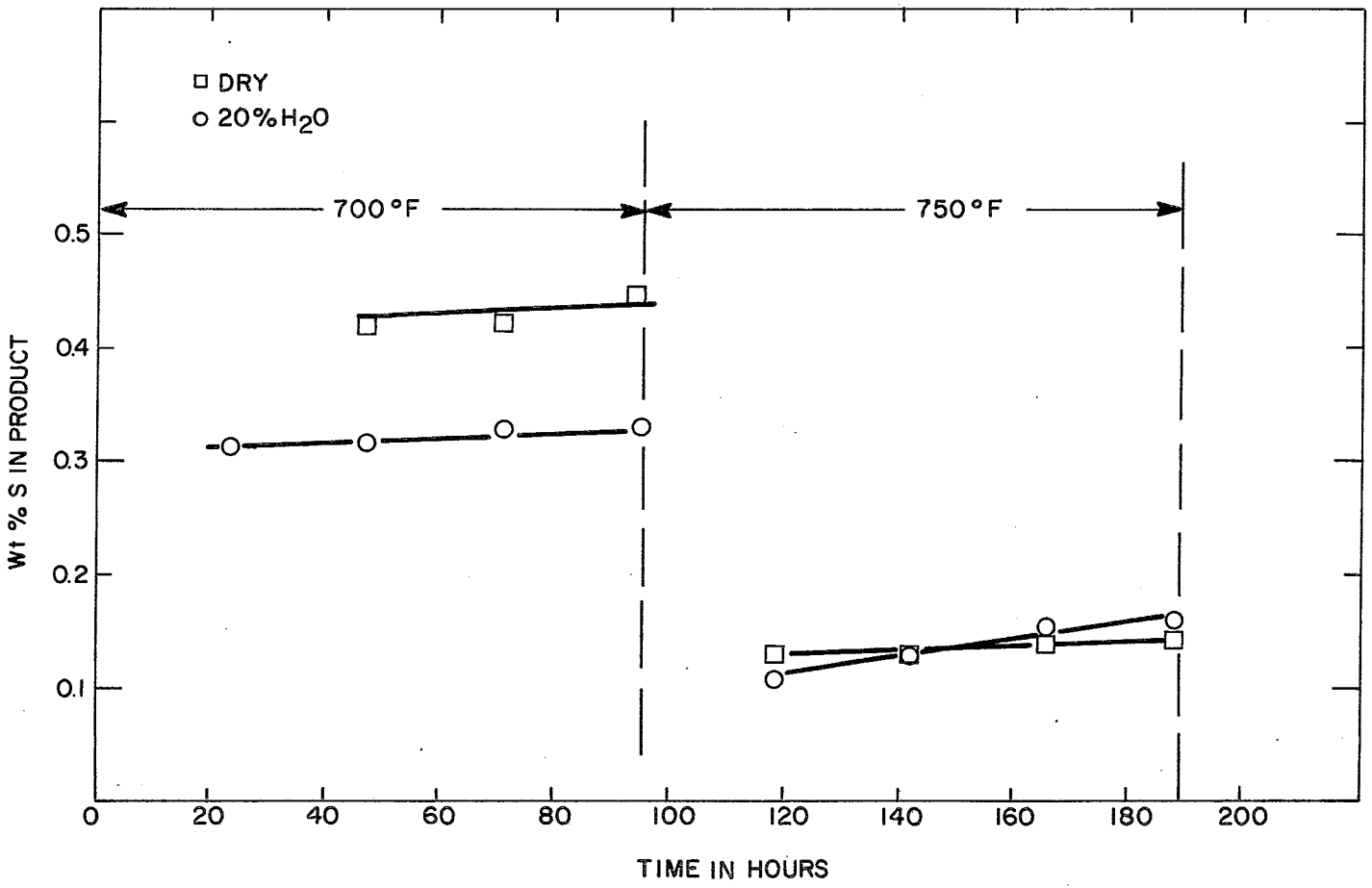
FIG. 2 is a graph relating the weight percent sulfur in the product to time on stream for a given hydrodesulfurization reaction.

Results of the reaction at 700° and at 750° F. are given in FIG. 2 in which the weight percent sulfur in the product is plotted against time on stream. At 700° F., lower weight percent sulfur is observed in the wet system and the activity maintenance appears to be the same for the wet or dry system. At 750° F., the weight percent sulfur in the product is essentially the same for the wet and dry systems for 100 hours of operation.

EXAMPLE 2

Hydrodesulfurization experiments in which the amount of steam present in the hydrodesulfurization zone was varied were conducted. The same Safaniya vacuum gas oil and the same catalyst that were described in Example 1 were utilized in a reactor maintained at a constant temperature of 650° F. and at a total pressure of 640 psig and at a gas oil liquid hourly space velocity of 2.78 volumes of oil per hour per volume of catalyst. The hydrogen treating gas rate was 3000 to 6000 scf/barrel of oil.

Figure 3:
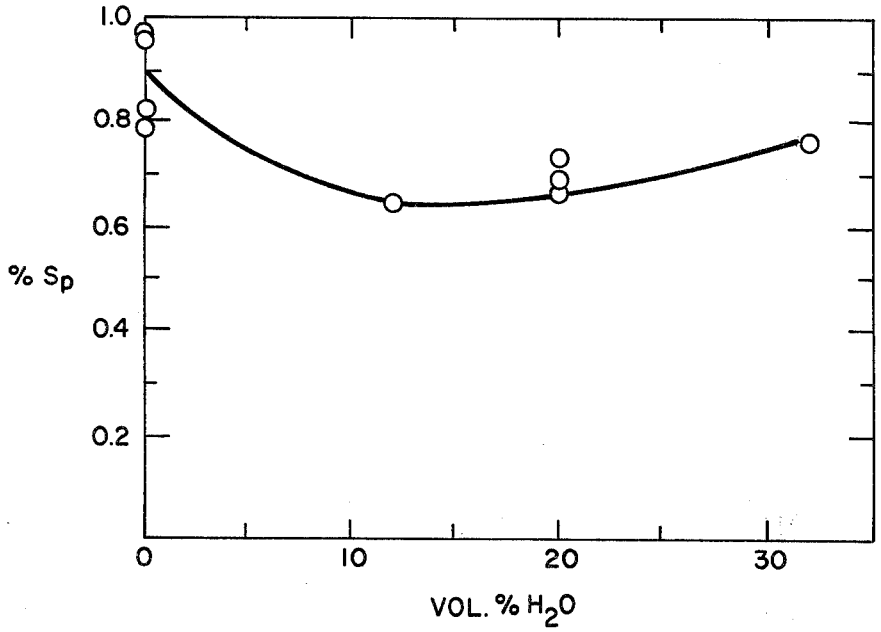
FIG. 3 is a graph relating weight percent sulfur in the product relative to volume percent water added to the hydrodesulfurization zone.

The amount of water was varied to provide from about 0 to about 32 volume percent steam based on the treating gas. Results of these experiments are shown in FIG. 3 in which are plotted weight percent sulfur in the product relative to the volume percent $H_2O$ in the hydrodesulfurization zone. As shown in FIG. 3, the optimum desulfurization occurred in the range of 10 to 25 volume percent $H_2O$. In the presence of 32 volume percent $H_2O$, less desulfurization occurred. Above 35 volume percent of added $H_2O$, the addition of steam to the given system is not expected to enhance desulfurization level significantly relative to hydrodesulfurization without the addition of steam.

EXAMPLE 3

Figure 4:
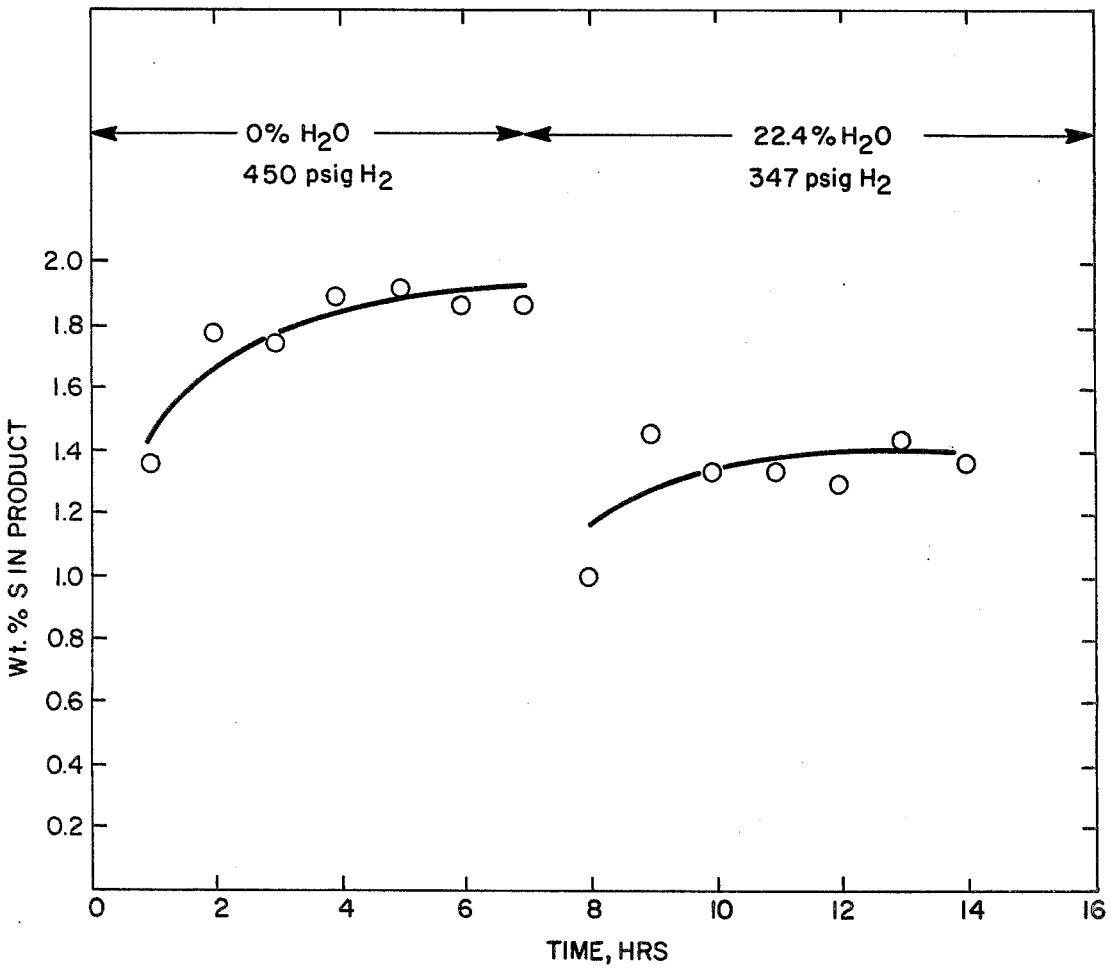
FIG. 4 is a graph relating weight percent sulfur in the product to time on stream for desulfurization of a dibenzothiophene in tetralin blend.

Another portion of the same catalyst described in Example 1 was calcined 3 hours at 1000° F. and sulfided with a 10 volume % of $H_2S$ in hydrogen stream at a temperature ranging from 75° to 600° F. for 16 hours. Feedstock containing 17 weight percent dibenzothiophene in tetralin blend (3.0% S by weight) was passed over the catalyst at about 3100 SCF/B. Products were collected periodically and analyzed for sulfur by X-ray fluorescence techniques. The initial part of the run was performed without water addition and the final part of the run with $H_2O$ addition to the extent of 22.4 volume percent $H_2O$ in the gaseous stream. As shown in FIG. 4, water addition resulted in a product containing substantially less sulfur. When these results are expressed in the form of reaction rate constants (see equation given in Example 1), the activity of the catalyst was found to increase over two-fold upon addition of $H_2O$ to this metals-free feed system. It is interesting to note that the desulfurization had increased in spite of the lower hydrogen partial pressure.

EXAMPLE 4

Tests were made to determine the influence of water in hydrogen refining of a virgin diesel oil feed. Another portion of the catalyst described in Example 1 was calcined 3 hours at 1000° F. The calcined catalyst was sulfided with a 10 volume percent of $H_2S$ in hydrogen stream at a temperature of 750° F. for 16 hours. Results of the tests are summarized in Table III.

The runs were conducted at a temperature of 600° F., a space velocity of 2.0 V/V/Hr., 4,000 SCF of hydrogen treat gas, with and without the addition of 20 volume percent $H_2O$ to the hydrogen treat gas.

TABLE III

| Run No. | 1 | | 2 | |
|---|---|---|---|---|
| Time on stream, hrs. | 0–135 | 135–189 | 0–90 | 90–159 |
| Vol.% $H_2O$ on treat gas | 0 | 0 | 0 | 20.6 |
| Pressure, psig | 245 | 190 | 245 | 245 |
| % HDN | 14.5 | 5.4 | 15.1 | 2.7 |

TABLE III-continued

| Run No. | 1 | | 2 | |
|---|---|---|---|---|
| % HDS | 84.7 | 83.0 | 85.0 | 87.2 |
| $k_s$, hr.$^{-1}$ | 3.99 | 4.52 | 4.14 | 7.31 |

HDN means hydrodenitrogenation
HDS means hydrodesulfurization

The above runs were conducted in side-by-side reactors in the same sandbath. Run 1 was conducted under dry conditions at two different pressure levels, i.e. 245 and 190 psig. Run 2 was initially conducted dry and then at hour 90, about 20 volume % $H_2O$ was introduced to the system keeping the total pressure constant at 245 psig. It can be seen that $H_2O$ increased the percent hydrodesulfurization even though the hydrogen partial pressure had been lowered. If the last part of Run 2 is compared to the part of Run 1 which was conducted at the same $H_2$ partial pressure of 190 psig, it is found that the percent hydrodesulfurization had increased from 83 to 87.2% and the rate constant from 4.5 to 7.3. This increase occurred in the absence of any vanadium or nickel compounds either in the feed or on the catalyst.

The virgi diesel oil used as feed in the runs summarized in Table III had the composition shown in Table IV.

TABLE IV

| Constituent | Weight Percent |
|---|---|
| sulfur | 1.09 |
| carbon | 86.03 |
| hydrogen | 12.98 |
| Conradson carbon | — |
| **Constituent** | **Weight ppm.** |
| nitrogen | 131 |
| Na | — |
| Ni | — |
| V | — |
| Fe | — |

What is claimed is:

1. A hydrodesulfurization process which comprises contacting, in a reaction zone, at hydrodesulfurization conditions, a substantially non-metal containing sulfur-bearing hydrocarbon feed selected from the group consisting of naphthas, vacuum gas oils, virgin gas oils, thermal and catalytic cycle oils, with a hydrogen-containing treating gas and a catalyst consisting essentially of cobalt metal, oxide or sulfide thereof and molybdenum metal, oxide or sulfide thereof; composited with an alumina carrier, and injecting into said reaction zone from about 1 to about 32 volume percent $H_2O$ based on said hydrogen-containing treating gas at start-of-run reaction zone temperatures ranging from about 550° to less than about 750° F., and discontinuing said injection of $H_2O$ into said reaction zone when the reaction zone temperature is about 750° F.

2. The process of claim 1 wherein said $H_2O$ comprises from about 5 to about 20 volume percent of said treating gas in said reaction zone.

3. The process of claim 1 wherein the partial pressure of said hydrogen in said reaction zone is at least 50 psig.

4. The process of claim 1 wherein said hydrodesulfurization conditions include a temperature ranging from about 550° to about 900° F. and a total pressure ranging from about 50 to about 4000 psig.

5. The process of claim 1 wherein said alumina carrier contains from about 1 to about 6 weight percent silica.

6. The process of claim 1 wherein said $H_2O$ is injected into said reaction zone as a liquid.

7. The process of claim 1 wherein said $H_2O$ is injected into said reaction zone as a vapor.

8. The process of claim 1 wherein said hydrocarbon feed has a liquid hourly space velocity of from about 0.3 to about 10.

9. The process of claim 1 wherein the hydrogen flow rate in said reaction zone ranges from about 100 standard cubic feet of hydrogen per barrel of hydrocarbon oil to about 10,000 standard cubic feet of hydrogen per barrel of hydrocarbon oil.

10. The process of claim 1 wherein said hydrodesulfurization conditions include a reaction zone temperature ranging from about 650° to about 850° F.

11. A process for the hydrodesulfurization of a sulfur-containing hydrocarbon feed containing less than 80 weight ppm metallic contaminants, which comprises: contacting said hydrocarbon feed in a reaction zone maintained at an average temperature ranging from about 650° to about 850° F. and at a total pressure ranging from about 100 to about 4000 psig with a hydrogen-containing gas, the partial pressure of the hydrogen being at least about 50 psig, and a catalyst consisting essentially of cobalt metal, oxide or sulfide thereof and molybdenum metal, oxide or sulfide thereof composited with an alumina carrier, introducing into said reaction zone from about 1 to about 32 volume percent $H_2O$ based on said hydrogen-containing gas at start-of-run temperatures ranging from about 550° to about 700° F., and discontinuing the introduction of $H_2O$ into said reaction zone when the reaction zone temperature is about 700° F.

12. The process of claim 11 wherein said alumina carrier additionally contains from about 1 to about 6 weight percent silica.

13. The process of claim 11 wherein said hydrocarbon feed contains less than 25 ppm. metallic contaminants.

14. The process of claim 11 wherein said hydrocarbon feed contains less than 5 ppm. metallic contaminants.

* * * * *